US006464471B1

(12) United States Patent
Mathis et al.

(10) Patent No.: US 6,464,471 B1
(45) Date of Patent: Oct. 15, 2002

(54) HIGH-EFFICIENCY MOTOR/PUMP SYSTEM FOR JETTED BATH/SPAS

(75) Inventors: Cleo D. Mathis, Hacienda Heights; Robert A. Miller, Huntington Beach, both of CA (US); Francesco Bottoni, Ferrara (IT); Giorgio Domenichini, Ferrara (IT); Cesare Bolboni, Ferrara (IT)

(73) Assignee: STA-RITE Industries, Inc., Delavan, WI (US)

( * ) Notice: Subject to any disclaimer, the term of this patent is extended or adjusted under 35 U.S.C. 154(b) by 0 days.

(21) Appl. No.: 09/345,407

(22) Filed: Jul. 4, 1999

Related U.S. Application Data

(60) Provisional application No. 60/099,469, filed on Sep. 8, 1998.

(51) Int. Cl.[7] ..... F04B 17/00

(52) U.S. Cl. ..... 417/350; 417/360; 417/423.8

(58) Field of Search ..... 417/350, 360, 417/372, 423.8, 423.14, 423.15, 359

(56) References Cited

U.S. PATENT DOCUMENTS 2,762,311 A * 9/1956 Litzenberg ..... 417/360
3,910,715 A * 10/1975 Yedidiah ..... 415/182
4,810,174 A * 3/1989 Stuckey et al. ..... 417/423.14
4,877,984 A * 10/1989 Colwell et al. ..... 417/380
5,055,006 A * 10/1991 Kobayashi ..... 417/366
5,302,885 A * 4/1994 Schwarz et al. ..... 318/781
5,911,565 A * 6/1999 Mann et al. ..... 417/423.8
6,210,129 B1 * 4/2001 Stiefel ..... 417/360

* cited by examiner

*Primary Examiner*—Charles G. Freay
*Assistant Examiner*—Michael K. Gray
(74) *Attorney, Agent, or Firm*—Wallace G. Walter

(57) ABSTRACT

A high-efficiency motor/pump system (20) for jetted baths/spas includes a pump assembly (22) removably secured to a motor assembly (24). The motor assembly (24) includes a motor (26) having a conventional laminated stator (30), a front housing (32) at the forward end of the motor (26), a rear housing (34) at the back end of the motor (26), and a ventilation plate (36) at the end of the rear housing (34). An armature-mounted internal fan (104) draws ambient air through openings in a ventilation plate (36) and forces the air through annular channels (80) in the rear housing (34) to effect cooling of the motor (26). The motor (26) is of the permanent split-capacitor type to eliminate the centrifugal switch commonly used in capacitor-start induction motors to thereby improve reliability. Additionally, telescoping structures on the forward end of the motor assembly and the rearward end of the pump assembly facilitate self-aligning assembly of the components.

2 Claims, 9 Drawing Sheets

HIGH-EFFICIENCY MOTOR/PUMP SYSTEM FOR JETTED BATH/SPAS

CROSS-REFERENCE TO RELATED APPLICATION

This application claims the benefit of commonly owned U.S. Provisional Patent Application No. 60/099,469 filed on Sep. 8, 1998

BACKGROUND OF THE INVENTION

The present invention relates to high-efficiency motor/pump systems for jetted baths/spas and, more particularly, to an improved cost-efficient motor/pump system having a motor specially suited for jetted baths/spas.

Historically, the motor/pump assemblies employed with jetted baths and spas have used a conventional standard-frame induction motor to drive a radial flow pump. The manufacturers of induction motors have developed industry-wide standardized 'classes' that define motor characteristics including power, torque, and frame sizes. Many electric motors used in the jetted bath/spa industry are of the split-phase capacitor-start type in which a capacitor in series-circuit with a starting winding creates a rotating magnetic field during start-up. Typically, a centrifugal switch disconnects the capacitor when the motor is at speed.

The creation of the 'standardized' classes with common frame sizes has presented the market with motors that have the same or nearly the same performance characteristics in a narrow price range. However, the standardized motor, which is suitable to a wide range of applications, has deficiencies when used in the jetted bath/spa market.

The requirements for motors that drive the pumps in jetted baths and spas are such that the forward end of the motor must be shielded from leakage of any fluid that leaks from the pump and, additionally, the motor should be cooled by forced air. Because the water that is used in jetted baths and spas often includes various types of detergents, soaps, bacteriacides, and other additives, it is critical that the interior of the motor be protected from the water. Additionally, it would be beneficial if the structure of the pump and the motor could facilitate the time-efficient assembly of the components at the time of manufacture.

In general, one of the most common failure modes for the motors is the malfunction of the centrifugal switch that interrupts the capacitor-start circuit when the motor is at speed. Since the motors/pump assemblies are typically installed as a "built-in" at the time of building construction, replacement or repair of a faulty centrifugal switch can be a difficult and time consuming task.

Accordingly, a need exists for a motor/pump system for use in jetted baths and spas by which the system is cost efficient and particularly suited to provide reliable operation in the bath and spa environment.

SUMMARY OF THE INVENTION

In view of the above, it is an object of the present invention, among others, to provide a high-efficiency motor/pump system for jetted baths/spas.

It is another object of the present invention to provide a high-efficiency motor/pump system for jetted baths/spas in which the starting capacitor used to start the motor remains in the motor circuit during both the start and run modes of the motor.

It is still another object of the present invention to provide a high-efficiency motor/pump system for jetted baths/spas having a housing structure that minimizes the probability of water leaking from the pump from entering the motor.

It is a further object of the present invention to provide a high-efficiency motor/pump system for jetted baths/spas having a rear housing designed to conduct fan-driven cooling air over the exterior surface of the motor to effect cooling thereof.

It is a still further object of the present invention to provide a high-efficiency motor/pump system for jetted baths/spas in which the design facilitates efficient assembly of the components.

In view of these objects, and others, the present invention provides a high-efficiency motor/pump system for jetted baths/spas including a water pump having an inlet and an outlet for connection to the associated piping and a motor for driving the pump. The motor is a capacitor-start single-phase induction motor in which the capacitor is in series circuit with an auxiliary coil to provide a starting torque. The capacitor is kept permanently wired in circuit with the starting coil to eliminate the need for a reliability reducing cut-out switch and to simplify manufacture. The forward portion of the motor housing is designed to minimize the possibility of water entering the motor housing, and the rear portion of the motor housing is designed to direct cooling air over the exterior of the motor. Additionally, the forward portion of the motor and the rearward portion of the pump are provided with telescoping structures designed to enhance time-efficient self-aligned connection between the motor and the pump at the time of assembly.

The present invention advantageously provides a high-efficiency motor/pump system for jetted baths/spas in which the start-up switching normally associated with these types of pumps is eliminated to increase reliability, in which the possibility of water leaking from the pump and entering the forward portion of the motor is reduced, and in which the pump motor is cooled by a forced air flow over the exterior of the motor stator.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
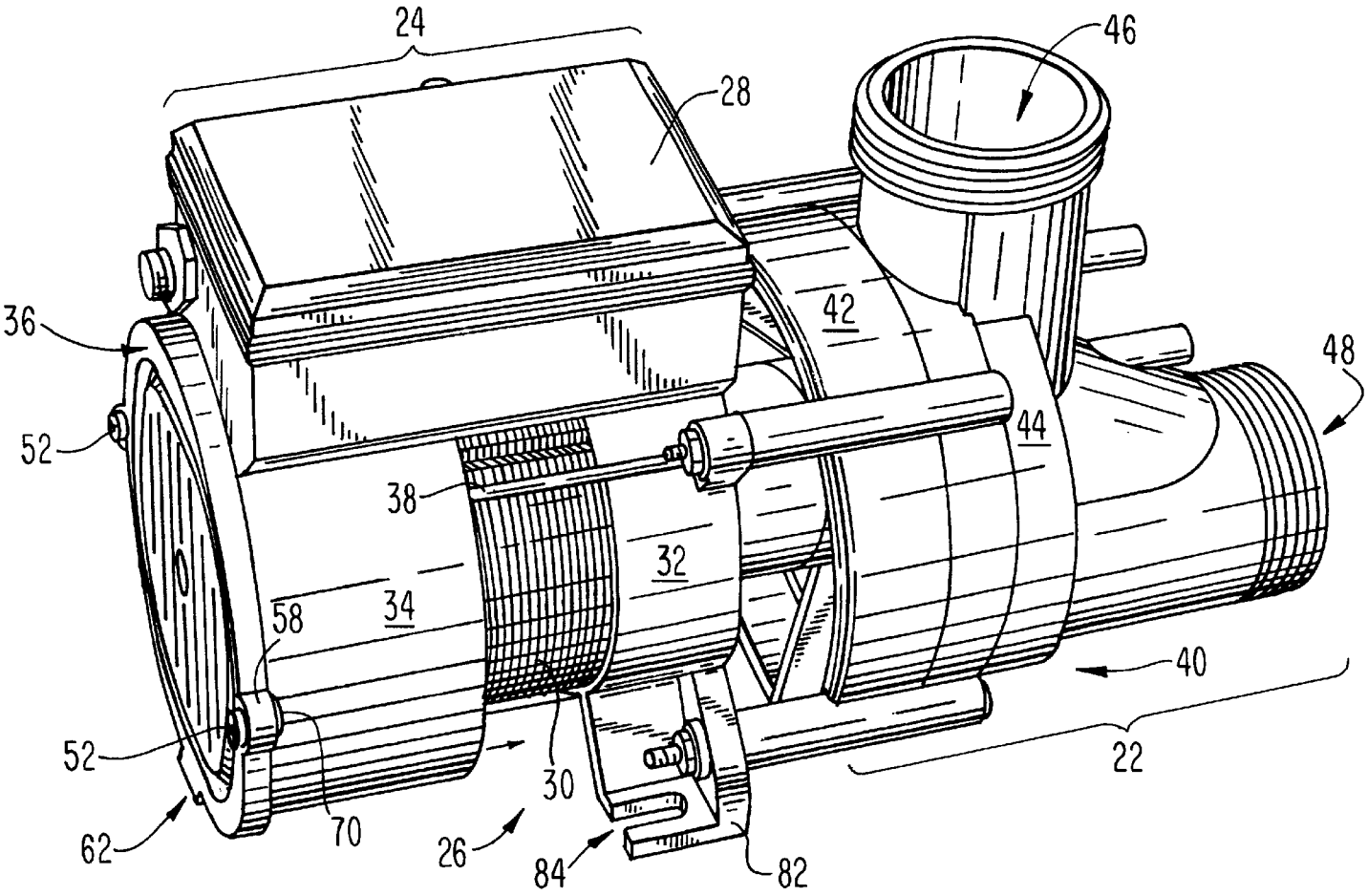
FIG. 1 is a side perspective view of a high-efficiency motor/pump system for jetted baths/spas in accordance with the present invention.

A high-efficiency motor/pump system for jetted baths/spas in accordance with the present invention is shown in FIG. 1 and designated generally therein by the reference character 20. As shown, the system 20 includes a pump assembly 22 removably secured to a motor assembly 24.

The motor assembly 24 includes a motor 26 and a electrical box 28 mounted atop the motor 26. The motor 26 includes a conventional laminated stator 30, a front housing 32 at the forward end of the motor 26, a rear housing 34 at the back end of the motor 26, and a ventilation plate 36 at the end of the rear housing 34. A set of motor assembly screws 38 clamps the stator 30 between the front housing 32 and the rear housing 34. As explained in more detail below, the motor 26 includes an armature connected to an internal fan (described below) mounted at the back end of the motor 26 to draw ambient air through openings in the ventilation plate 36 and force the air through annular channels in the rear housing 34 to effect cooling of the motor 26. A representative air-flow cooling arrow is shown in the lower part of both FIGS. 1 and 2.

The pump assembly 22 is formed as a two-part pump housing 40 from molded plastic and includes a rear pump sub-housing 42 and a front pump sub-housing 44 that are secured together with appropriate threaded fasteners 50. The front pump sub-housing 44 includes a pump outlet 46 from which pressurized water is output from the pump assembly 22 and an pump inlet 48 through which water enters the pump assembly 22. As explained in more detail below, an impeller is mounted internally of the pump housing 40 and is driven by the motor 26.

Figure 3:
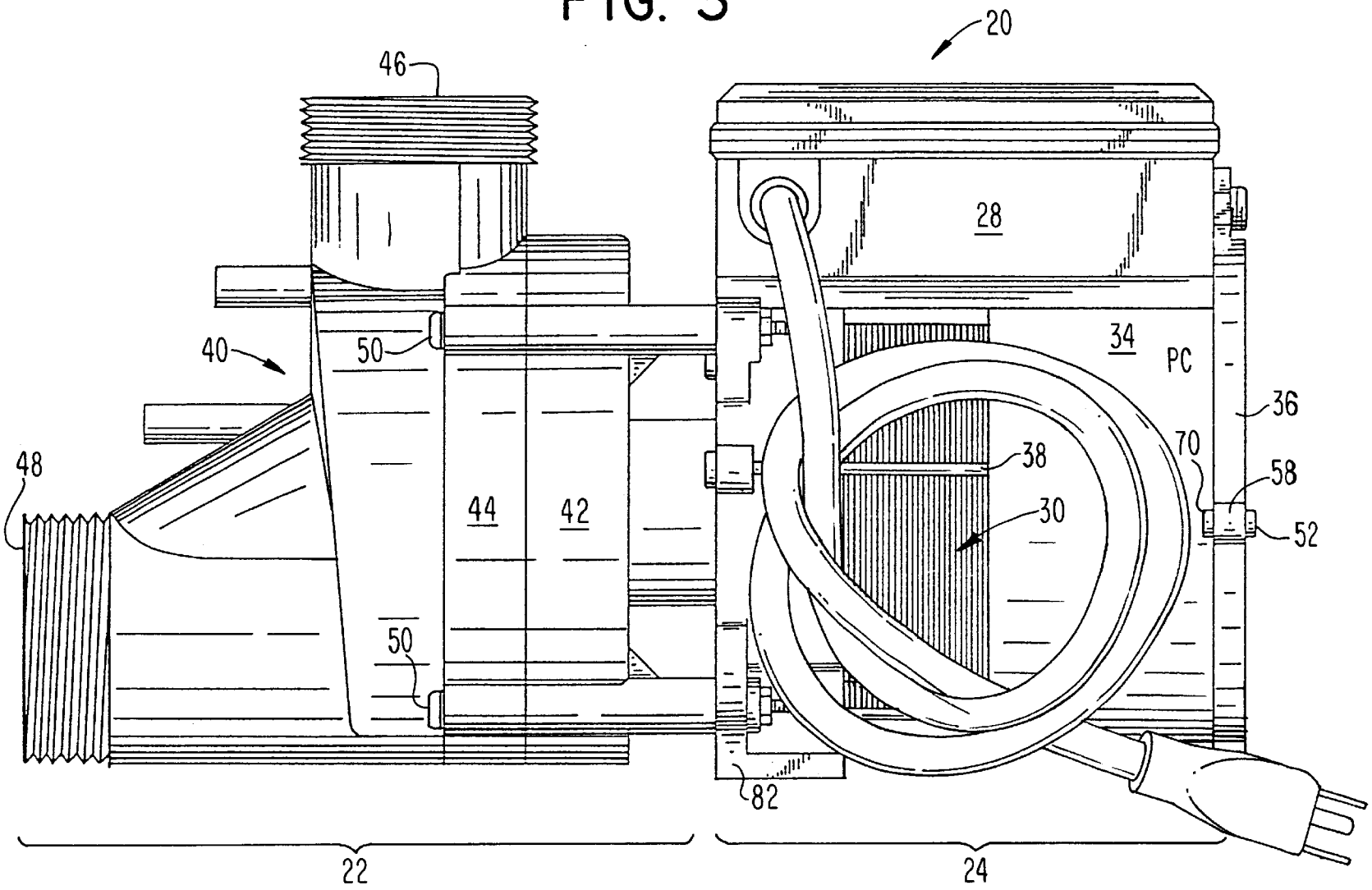
FIG. 3 is a side elevational view of the high-efficiency motor/pump system of FIG. 1 shown on the side opposite from that of FIG. 1.
Figure 4:
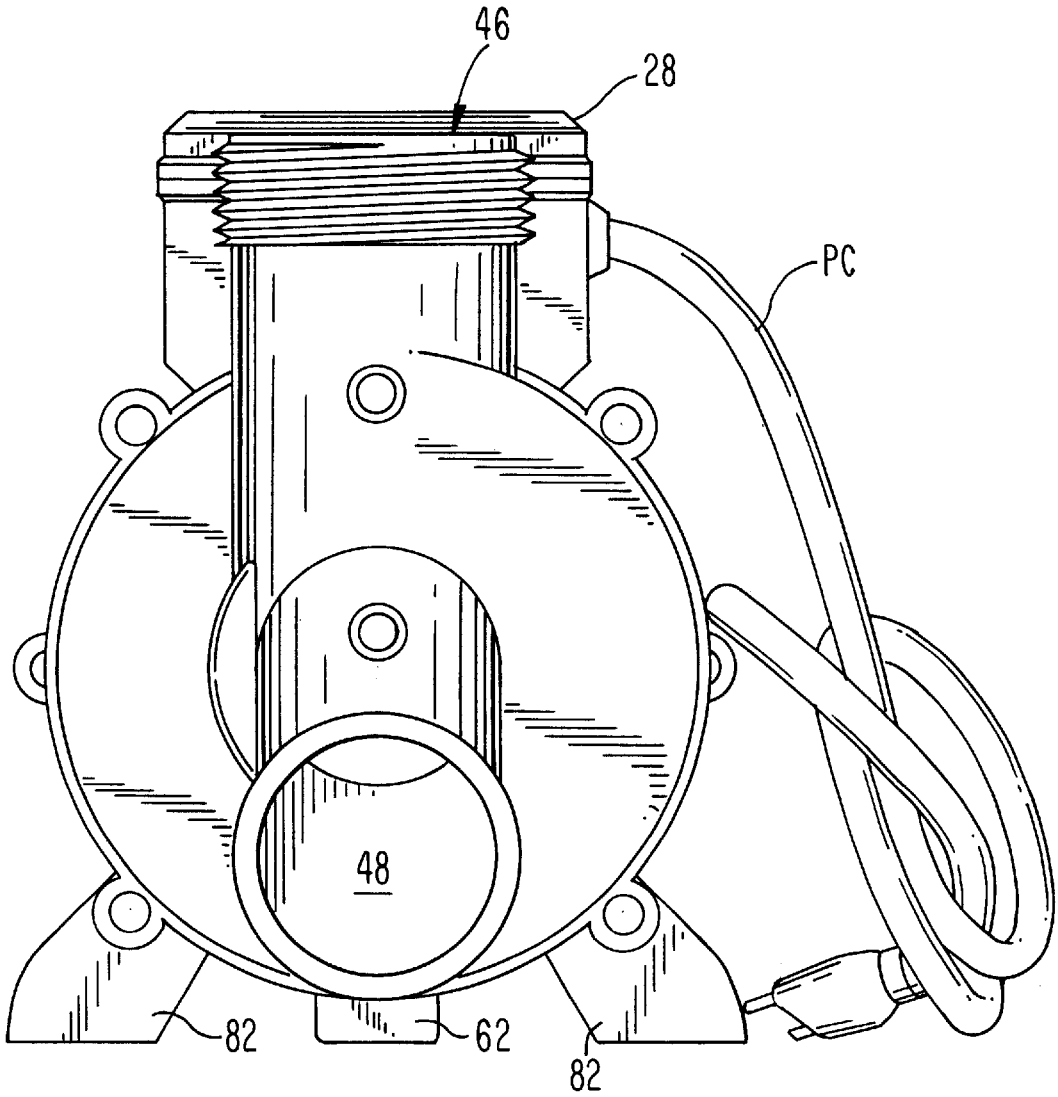
FIG. 4 is a front elevational view of the high-efficiency motor/pump system of FIG. 1.
Figure 5:
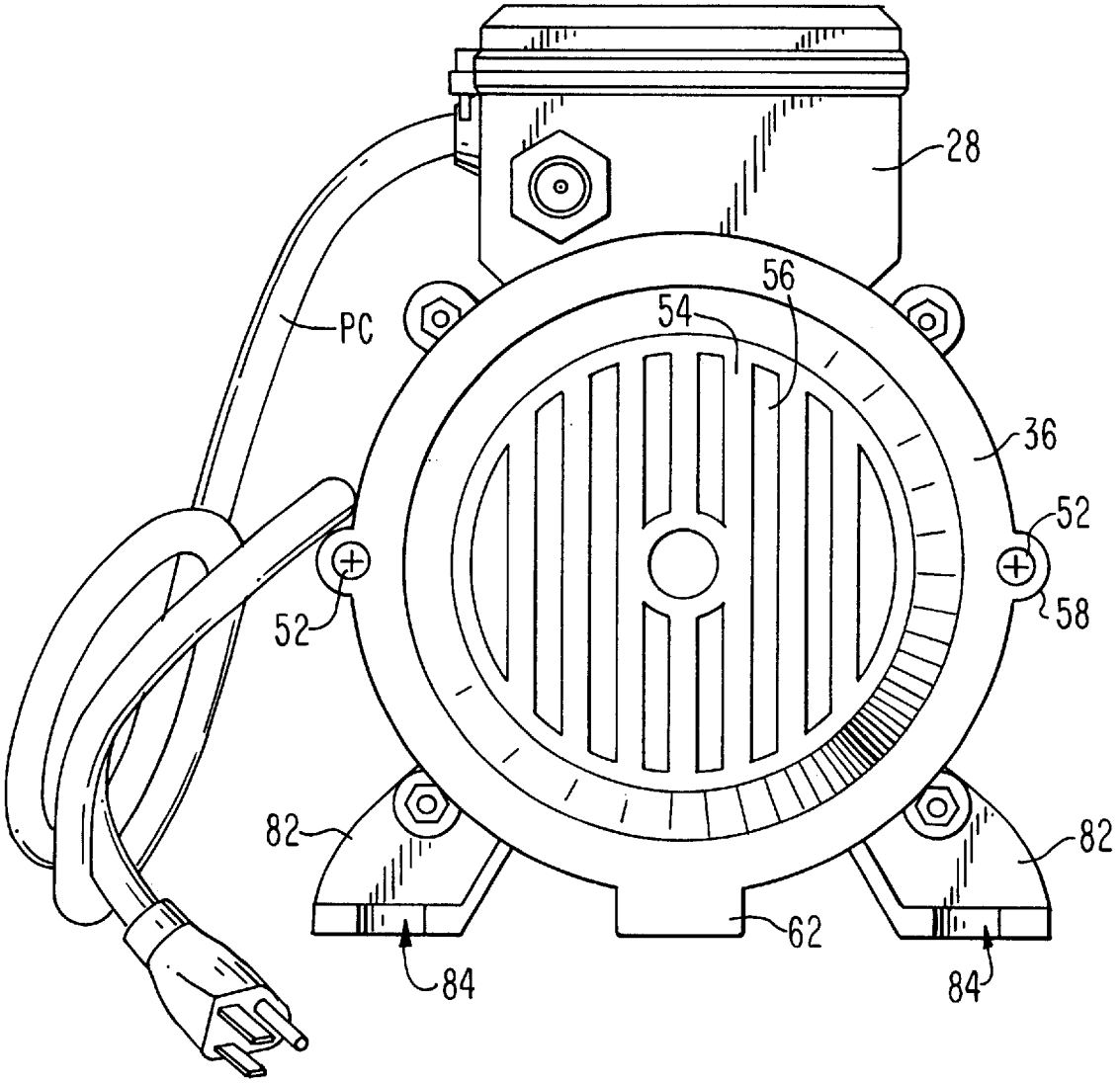
FIG. 5 is a rear elevational view of the high-efficiency motor/pump system of FIG. 1.

As shown in FIGS. 3, 4, and 5, a conventional power cord PC is connected to the electrical box 28, which, in turn, includes a capacitor (not shown) for effecting motor starting. In conventional capacitor-start motors, the starting-capacitor is switched-out of the induction coil circuit by a centrifugal switch after the motor has started and reached a selected speed. In the system 20 of the present invention, the capacitor is permanently wired into the induction coil circuits and the need for a centrifugal switch is eliminated. Since the centrifugal switch contacts represent the most common failure modes for induction motors in jetted bath/spa applications, the present arrangement effectively increases system reliability.

Figure 6:
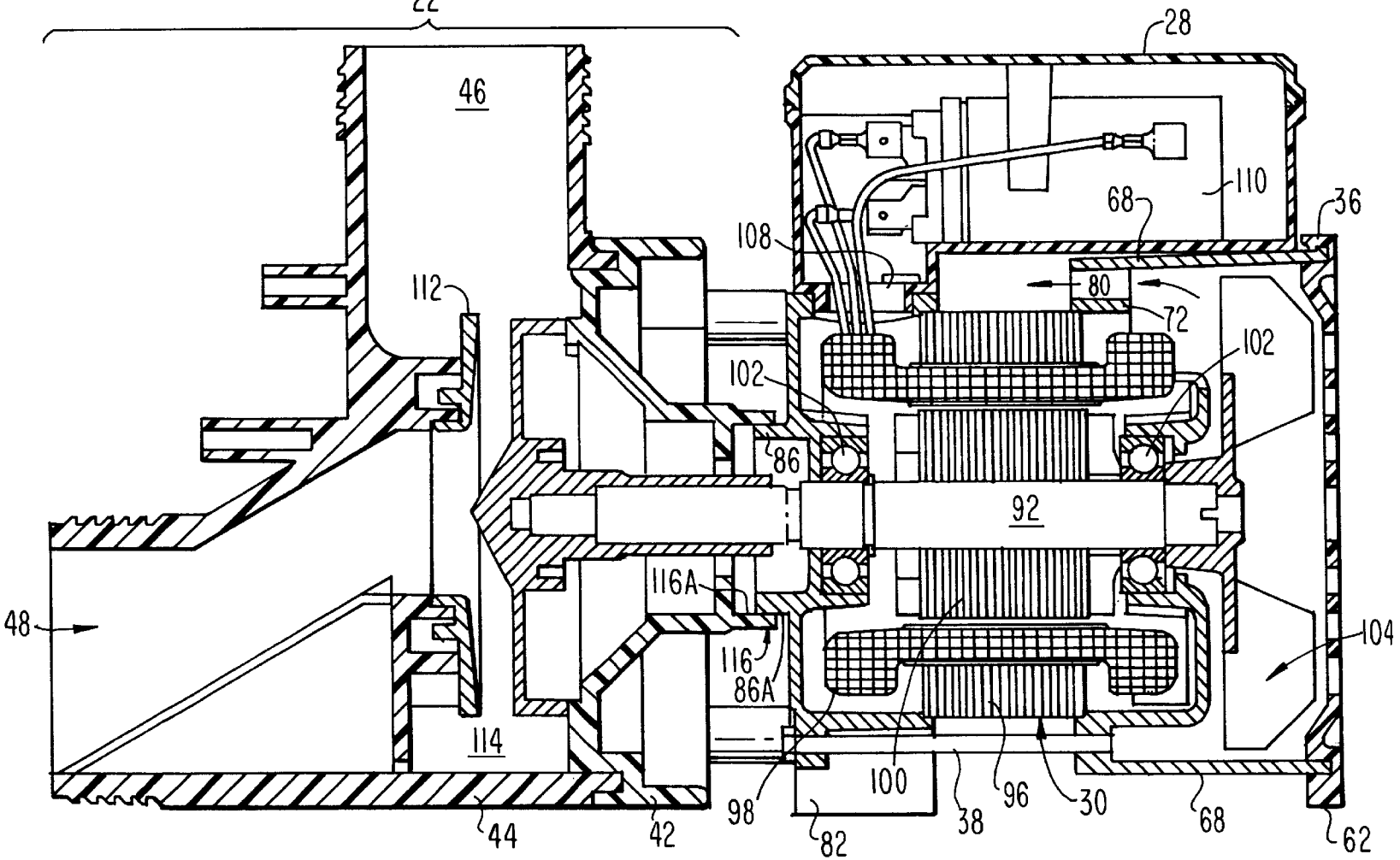
FIG. 6 is a side elevational view, in cross-sectional, of the high-efficiency motor/pump system of FIG. 3.
Figure 8:
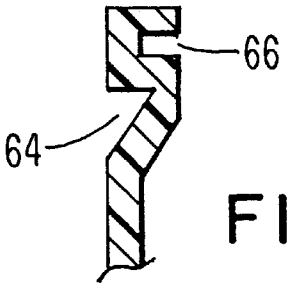
FIG. 8 is a partial view, in cross-section, of a portion of the ventilation plate of FIG. 7.
Figure 7:
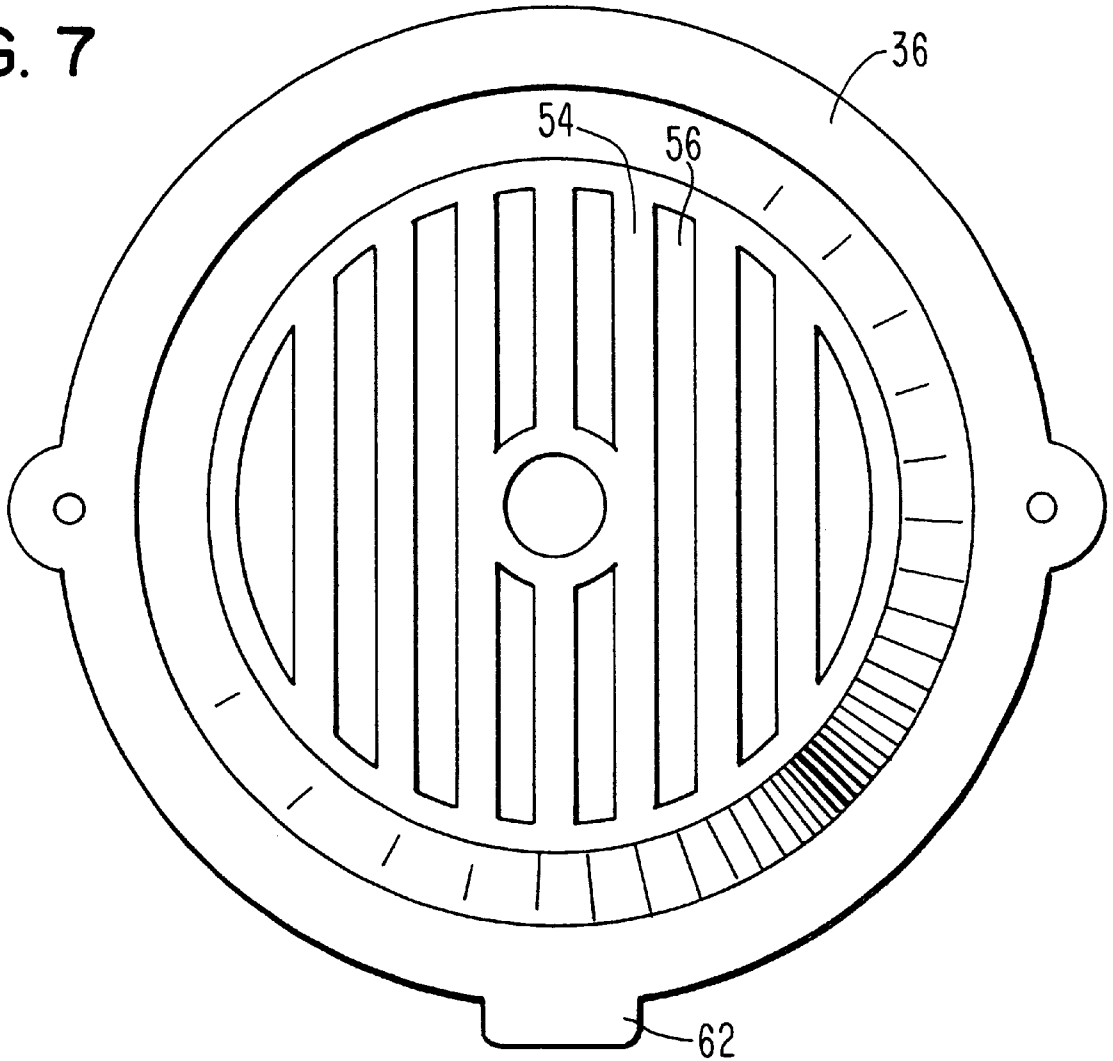
FIG. 7 is an elevational view of a rear-mounted ventilation plate.

As shown in FIGS. 5, 6, and 7, the ventilation plate 36 is secured by two ventplate screws 52 to the rear of the rear housing 34. The ventilation plate 36 is typically molded from a thermosetting plastic and includes a series of parallel-spaced bars 54 that define inter-bar spaces 56 therebetween. Two diametrically opposed bosses 58 includes holes (unnumbered) through which the ventplate screws 52 secure the ventilation plate 36 in place on the rear housing 34. A support foot 62 is formed along a circumferential portion of the ventilation plate 36 and functions to support the rear portion of the system 20. The support foot 62 (FIG. 5) cooperates with legs (described below) at the forward end of the motor assembly 24. As shown in the cross-sectional view FIG. 8, the ventilation plate 36 is formed with a notch 64 on its outward side and a circumferential groove 66 that accepts and receives the cylindrical end of the rear housing 34.

Figure 2:
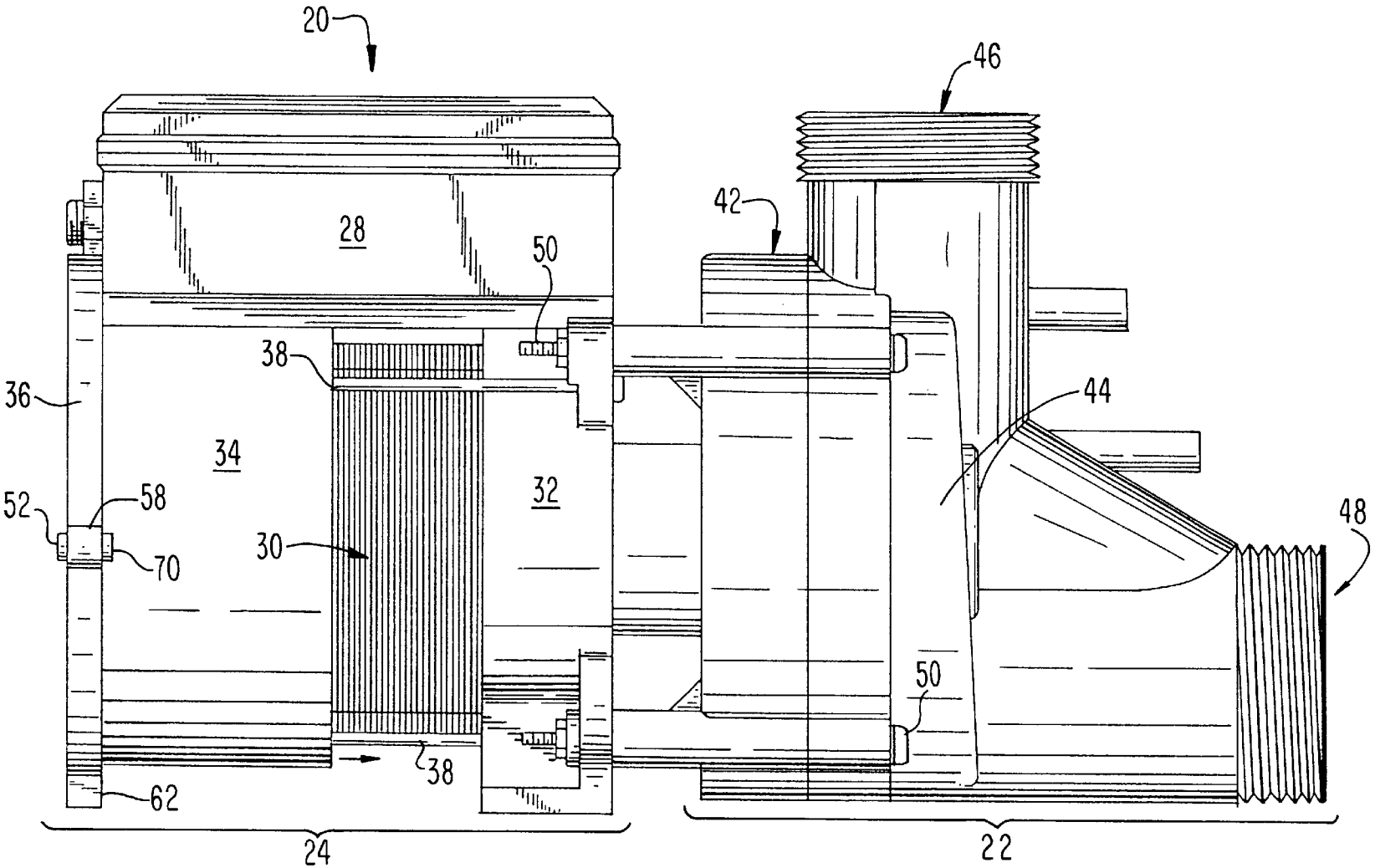
FIG. 2 is a side elevational view of the high-efficiency motor/pump system of FIG. 1.
Figure 9:
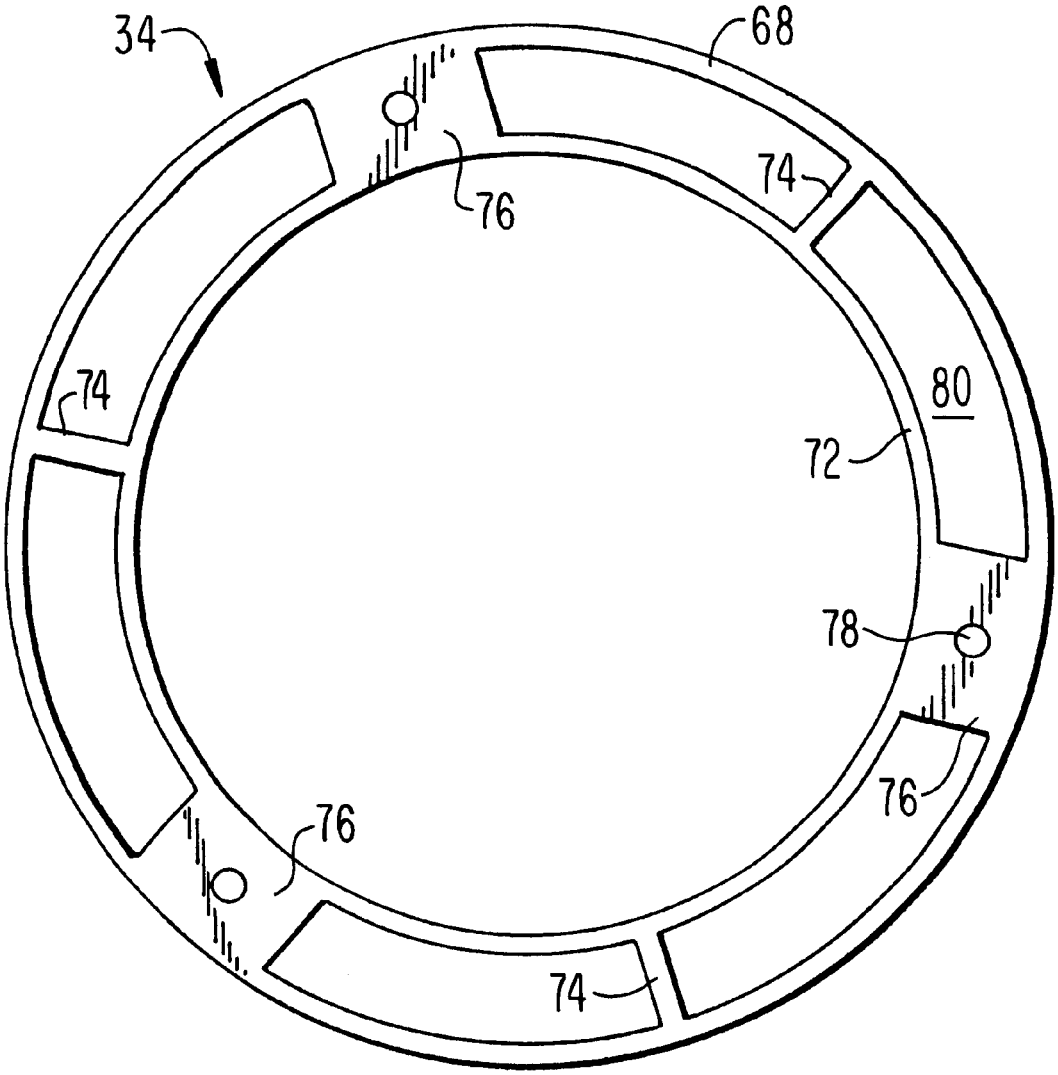
FIG. 9 is a view of the forward-facing end of the rear housing.

As best shown in FIGS. 1, 2, and 6, the rear housing 34 is preferably formed from a light-metal casting (i.e., aluminum) and includes a near-cylindrical outer shell 68 that tapers slightly from the rear portion to the forwardmost portion. The rearmost end of the rear housing 34 is circular and is designed to be received within the groove 66 (FIG. 8) of the ventilation plate 36. The diametrically outstanding bosses 70 receive ventplate screws 52 that secure the ventilation plate 36 in place at the rear of the rear housing 34. The forward facing surface of the rear housing 34 is shown in FIG. 9. As shown, a cylindrically shaped inner shell 72 is concentrically located within the outer sleeve or shell 68 and held in position by support struts 74 and supports 76. A threaded hole 78 is formed in each support 76 and is designed to receive the above-mentioned motor assembly screws 38 that clamp the motor 26 between the front housing 32 and the rear housing 34. The support struts 74 and the supports 76, along with the outer shell 68 and the inner shell 72, define six (in the case of the preferred embodiment) air flow openings or channels 80 that direct a flow of cooling air over the exterior of the motor 26, as explained more fully below. As shown in FIG. 6, the inner shell 72 has an axial length substantially less than the overall axial length of the outer shell 68. The volume defined rearwardly of the rear edge of the inner shell 72 can be viewed as an air plenum or chamber from which cooling air is directed forward through the channels 80.

Figure 10:
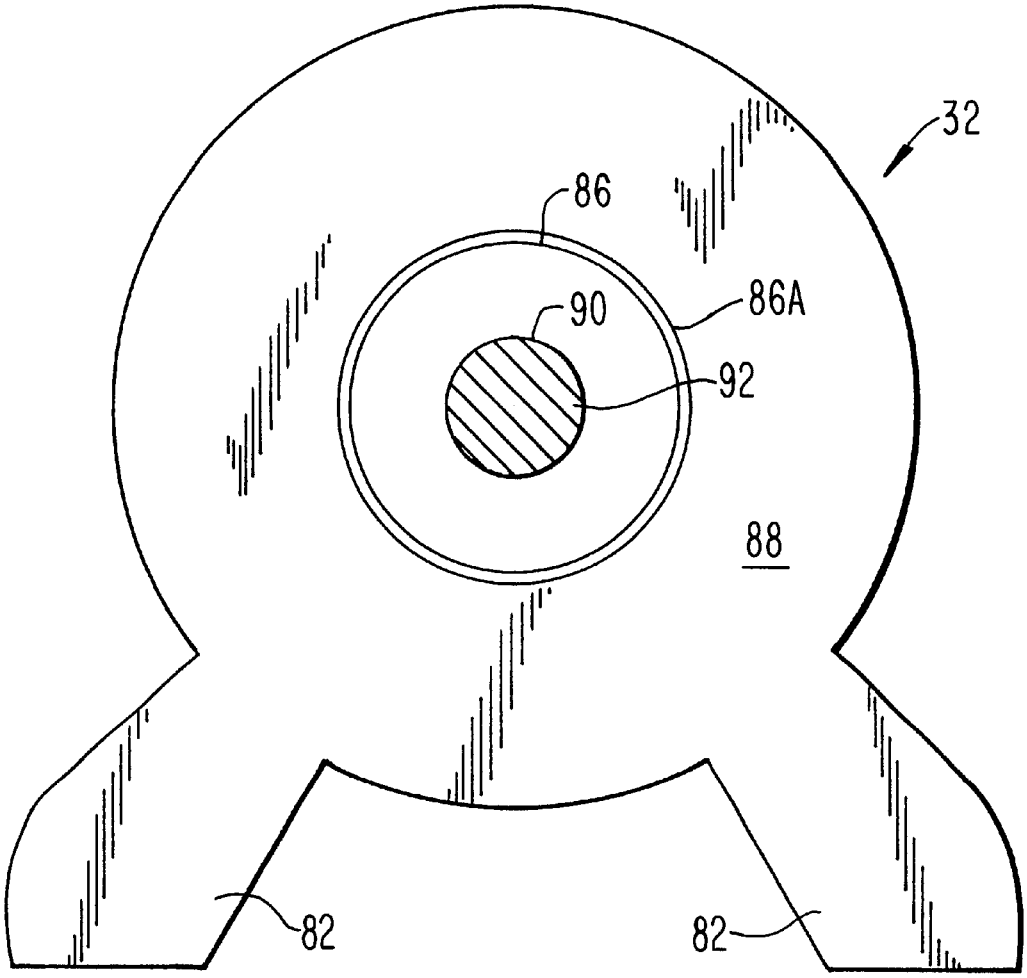
FIG. 10 is a view of the forward-facing surface of the front housing.

The front housing 32 is shown in elevation in FIG. 10 and, as shown, include integral first and second front support legs 82 that support the front housing 32 above its mounting surface. As shown in FIG. 1, the bottom of each front support leg 82 includes a longitudinally extending mounting slot 84 through which mounting fasteners (not shown) are passed. As shown in FIGS. 6 and 10, a cylindrical collar 86 extends from the front surface 88 of the front housing 32. A clearance bore 90 is formed in the center of the cylindrical collar 86 through which the motor shaft 92 extends. The front surface 88 of the front housing 32 is without any openings or apertures to minimize the possibility that any water leaking or otherwise escaping from the pump assembly 22 or the associated piping will enter the internal portions of the motor assembly 24 from the forward side thereof.

As shown in FIG. 6, the motor 26 is of the induction type and includes the stator 30 defined by a lamination stack 96 and stator coil winding 98. An armature or rotor 100 is carried on the motor shaft 92 which, in turn, is mounted for rotation on ball bearings 102. The lamination stack 96 is effectively retained or clamped between the front housing 32 and the rear housing 34. While not specifically shown, circumferential ledges are provided on the surfaces of the front housing 32 and the rear housing 34 into which the lamination stack 96 is fitted. The screws 38 extend through the front housing 32 and engage the threaded holes 78 to secure the components together. A multi-bladed fan 104 is secured to the rearward end of the motor shaft 92 for rotation with the motor shaft 92 and occupies the air plenum chamber described above. The fan 104 draws ambient air through the inter-bar spaces 56 in the ventilation plate 36 and forces the air through the above described (FIG. 9) rear housing openings 80 to direct the air flow over the exterior the lamination stack 96 to effect cooling of the motor 26 from the exterior. Representative air-flow arrows are shown in FIG. 6, FIG. 1 and FIG. 2.

The various wires (unnumbered) from the stator coil winding 94 pass through a wire opening 108 in the front housing 32 and into the electrical box 28 to connect to the starting capacitor 110 and to the power cord PC in the conventional manner.

A pump rotor 112 is in threaded engagement with and is carried on the distal end of the motor shaft 92 and rotates within a pump chamber 114 defined between the assembled front pump sub-housing 44 and the rear pump sub-housing 42. While not specifically shown, one or more shaft seals are provided in the rear pump sub-housing 42 to prevent water leakage therefrom as described in U.S. patent application Ser. No. 09/007,774 filed Jan. 16, 1998 and incorporated herein by reference. The rear surface of the pump sub-housing 42 includes a pump collar 116 that is designed to concentrically and telescopically fit over the cylindrical collar 86 of the front motor housing 32 to protect the rotating shaft from contamination. The telescopic relationship between the cylindrical collar 86 of the front housing 32 and the pump collar 116 also facilitates the self-aligning or self-guiding mating or assembly of the pump assembly 22 to the motor assembly 24 during fabrication. In FIG. 6, the pump collar 116 is shown as diametrically larger than the collar 82 and as telescopically receiving the collar 82. As can be appreciated, the collar 82 can be fabricated as the larger structure to telescopically received the pump collar 116. If desired, the two collars 82 and 116 can be dimensioned to create an interference fit when the parts are assembled.

The present invention advantageously provides a high-efficiency motor/pump system for jetted baths/spas in which the start-up switching normally associated with these types of pumps is eliminated to increase reliability, in which the possibility of water leaking from the pump and entering the forward portion of the motor is reduce, in which the pump motor is cooled by a forced air flow over the exterior of the motor stator, and by which telescoping formations on the motor and the pump facilitate a self-aligning assembly of the parts.

As will be apparent to those skilled in the art, various changes and modifications may be made to the illustrated high-efficiency motor/pump system for jetted baths/spas of the present invention without departing from the spirit and scope of the invention as determined in the appended claims and their legal equivalent.

What is claimed is:

1. A motor/pump assembly, comprising:

a motor assembly having a front housing and a rear housing and a motor retained therebetween;

said motor having a shaft mounted for rotation about an axis;

a pump connected to said motor assembly at the front end thereof for pumping a fluid therethrough;

said rear housing having circumferentially spaced air flow channels therein for directing an air flow in the forward direction toward the pump over at least an exterior surface of said motor, said rear housing defined by an outer cylindrical shell and a smaller diameter inner cylindrical shell with a plurality of struts connecting the inner and outer cylindrical shells, the air flow channels defined between the inner and outer shells; and a fan mounted on said shaft for rotation therewith for moving ambient air through the channels of said rear housing in the forward direction toward the pump and over the exterior surface of said motor to effect cooling thereof.

2. The motor/pump assembly of claim 1, wherein the inner shell has an axial length less than the overall axial length of the outer shell to define an air plenum or chamber from which cooling air is directed forwardly through the channels.

* * * * *